United States Patent [19]

Plaot

[11] 3,959,802

[45] May 25, 1976

[54] MEANS FOR RECORDING CHARACTER IMAGES IN SIDE BY SIDE RELATIONSHIP IN A PHOTOCOMPOSING MACHINE

[75] Inventor: Michael Plaot, Eschborn, Germany

[73] Assignee: Mergenthaler Linotype GmbH, Frankfurt, Germany

[22] Filed: Mar. 10, 1975

[21] Appl. No.: 556,830

[30] Foreign Application Priority Data

Mar. 12, 1974 Germany ..... 2411721

[52] U.S. Cl. ..... 354/12; 350/285; 354/5

[51] Int. Cl.[2] ..... B41B 17/18

[58] Field of Search ..... 354/5, 10, 12, 13, 4; 350/285; 355/43; 178/7.6

[56] References Cited

UNITED STATES PATENTS

| | | | |
|---|---|---|---|
| 2,670,665 | 3/1954 | Caldwell | 354/13 |
| 3,530,780 | 9/1970 | Haynes | 354/14 |

*Primary Examiner*—Joseph W. Hartary
*Attorney, Agent, or Firm*—William P. Keegan

[57] ABSTRACT

An apparatus for use in a photocomposing machine for placing character images in side by side relationship on a recording medium, which apparatus comprises two periscopes arranged such that the exit axis of the first periscope coincides with the entrance axis of the second periscope and in which both periscopes are swingable about axes that coincide with the entrance axes of the respective periscopes.

3 Claims, 1 Drawing Figure

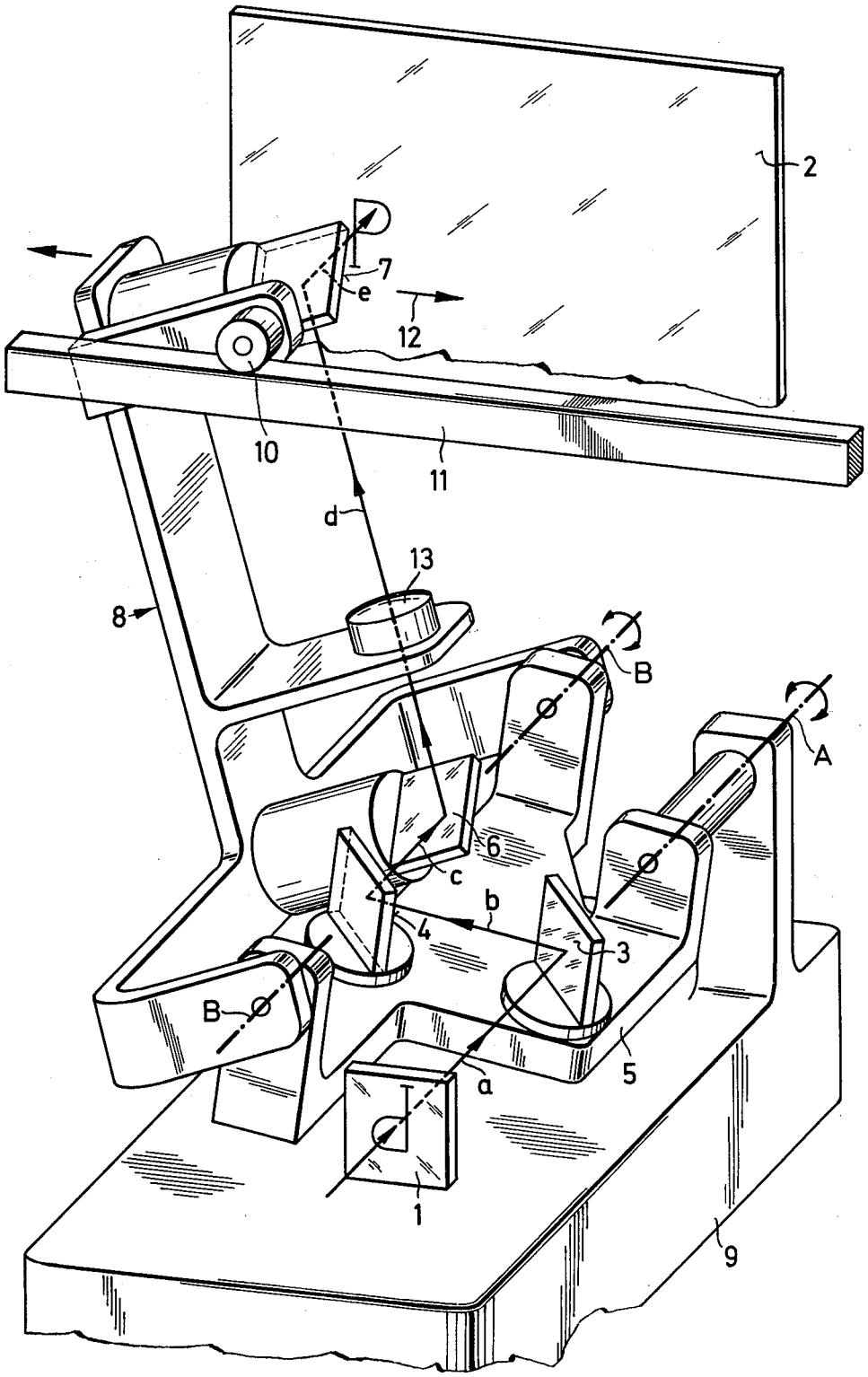
2
7
e
12
10
11
d
13
8
B
A
6
c
b
4
3
B
5
a
1
9

MEANS FOR RECORDING CHARACTER IMAGES IN SIDE BY SIDE RELATIONSHIP IN A PHOTOCOMPOSING MACHINE

DETAILED DESCRIPTION

This invention relates to photocomposing machines, and especially to the mechanism for laying down character images in side by side relationship on the recording medium.

More particularly, the invention relates to an apparatus for displacing the place of imaging on a recording medium in a photocomposing machine with the use of a system of mirrors arranged in the optical axis of an imaging system between a character support and the recording medium. The apparatus comprises four mirrors inclined 45° to the optical axis and directed parallel to each other in pairs. The position of at least one mirror with respect to the recording medium, and the positions of the mirrors with respect to each other, are variable to displace the character image positions along a straight line, but the mirror positions are varied in such a manner that the length of the optical path between the recording medium and the character support remains constant.

In one such device having a constant imaging distance (German Pat. No. 1,210,324) the light beam coming from a picture lens arrives on a stationary mirror which is part of a mirror system which includes three other mirrors. The three other mirrors are displaceable with respect to the recording medium. Specifically, parallel to the stationary mirror there is a second mirror opposite which there is a third mirror which, however, is inclined a full 90° with respect to the second mirror. The fourth mirror, which faces the recording medium, is in its turn parallel to the third mirror. In order to compose lines of text, i.e., to project character images to the recording medium in side by side relationship, the fourth mirror facing the recording medium is displaced after each character image is recorded by a distance equal to the width of the projected character while the pair of mirrors consisting of the second and the third mirrors is moved in the same direction by one-half this distance so as to maintain the optical distance from the picture lens to the recording medium constant to thereby insure that all character images are focused sharply on the recording medium. This apparatus has the disadvantage that a mechanical transmission must be provided between the fourth mirror which faces the recording medium and the pair of mirrors, consisting of the second and the third mirrors, which is displaceable by half the distance. The mechanism is thus relatively expensive and can produce errors in adjustment which are undesirable in high grade composition. The mirror system is furthermore sensitive to tilt errors, in particular because the fourth mirror which faces the recording medium and the third mirror, in the same way as the second and the first mirrors which are parallel to each other, cannot be firmly connected together.

Another known device for displacing the point of focusing character images on the recording medium in photocomposing machines consists in moving the recording medium itself with respect to the optical axis. With such an arrangement, however, there is the disadvantage that relatively large masses must be accelerated and decelerated for each character image projected.

In accordance with another principle which also is part of the prior art, the place of focusing on a recording medium is moved to the desired point by a pivotting mirror arranged in the optical axis. In order for the recorded character images to be free of distortion in such a device, it is necessary, if no special measures are taken by the use of a corrective lens system, to have all points of projection on the recording medium at the same distance from the axis about which the mirror pivots, or in other words, the recording medium has to be held on a curved surface. The guiding and pressing mechanism for holding the recording medium or film in a curved plane means an additional expense as compared with the corresponding equipment for a recording medium which is spread out flat in the region of focusing the image.

The object of the present invention is to provide a device for displacing the place of focusing a character image on the recording medium in a photocomposing machine which maintains the length of the optical path constant between the recording medium and the character support regardless of where, within a line, the character image is to be recorded, and in which the accuracy of focusing is not impaired by tilt errors in the guides of the optical elements. A mechanical transmission between the optical elements which are movable with respect to each other is to be avoided in order to assure precision and the elimination of alignment errors. An objective lens which images the character is to be capable of being arranged at practically any desired along the optical axis. In addition, the apparatus should be relatively low in weight and, furthermore, its cost of manufacture should be relatively low.

In order to achieve this objective a technique is followed which is known in principle in connection with a character selecting device for a photocomposing machine. See, for example, German Provisional Patent No. 1,422,493. In the character selecting device there disclosed, at least one parallelepiped prism is provided having face surfaces extending in parallel inclined by 45° around the longitudinal axis of the parallelepiped prism. The parallelepiped prism is so arranged that a beam of light emerging from the characters to be imaged falls on the one end surface, is reflected there by 90°, moves further along the longitudinal axis of the parallelepiped prism and is again reflected by 90° at the other end surface in such a manner that the beam of light leaves the parallelepiped prism along the optical axis of the focusing system. Such a device has the property that no image rotation takes place when it is moved, i.e., the picture remains vertical and with correct side to side relationship. The parallelepiped prism can be so swung here around the optical axis of the focusing system that its end surface which faces a rotating character support which has at least two rows of characters in concentric circles, covers only one row of the characters. In order to direct the source of light against the selected row of characters another parallelepiped prism is provided which is developed and arranged, with respect to the character support or disk, in mirror symmetry to the first parallelepiped prism and which can be swung jointly with the first parallelepiped prism, i.e., parallel to it. With these parallelepiped prisms their end surfaces facing a row of characters are moved along an arcuate path. However, in order to achieve the desired goal of the present invention, which is to displace the place of focusing on a recording medium, i.e., imaging successive characters in side by side relationship, a linear displacement along a line is required.

In accordance with the present invention, two periscopes arranged one behind the other and swingable with respect to each other around two axes parallel to each other are provided. With such a system, a selected character can be focused on the recording medium at practically any desired place without change in focus or image rotation. For the linear displacement of the position of focusing on the recording medium, as a further development of the device, the mirror of the second periscope facing the recording medium is guided for linear displacement parallel to the plane of the recording medium. Furthermore, it may be advisable to arrange an objective lens on one of the supports of the periscopes so that the two periscopes form a relay system with the objective lens.

Features and advantages of the invention may be gained from the foregoing and from the description of a preferred embodiment of the invention which follows.

In the sole FIGURE of the drawing the apparatus of the present invention is shown in a perspective view.

In the drawing parts of the optical system are omitted insofar as they relate to the illumination of the character support, a desired adjustment of type size, and any additionally required deflection of the optical axis for reasons of space.

Referring now to the drawing, a character support is shown by the reference numeral 1. A selected character on this support is to be projected at any desired point on the recording medium. The character support may be in the form of a rotating disk or drum, or any of the other well known forms of character carriers. Also, instead of a character support of the type shown in the drawing, there can be present here in another embodiment merely an intermediate optical image which is produced by optical elements not shown in the drawing.

In the optical axis between the character support and the recording medium there is located a system which consists of a periscope with mirrors 3 and 4 which are arranged parallel to each other on a support 5, and of a following second periscope comprising the mirrors 6 and 7 which are aligned with respect to each other on a support 8. The support 5 for the first periscope is swingable around an axis A—A on a base 9. The support 8 of the second periscope can be swung around an axis B—B which is parallel to the axis A—A and can itself be swung together with the first periscope around the axis A—A. The axes A—A and B—B are by construction so made with stub shafts that no mechanical elements extend into the optical axis. The portion of the support 8 lying opposite the axis B—B is guided by a roller 10 on a linear guide 11 parallel to the line direction 12.

An objective lens 13 is furthermore provided on the second support 8 between the mirrors 6 and 7.

The optical axis of the device which passes through the center of curvature of the objective lens 13 consists, insofar as of interest with respect to the present invention of the following sections; section *a* between the character support and the mirror 3 of the first periscope, which at the same time forms the entrance axis of the first periscope; section *b* between the mirrors 3 and 4 as longitudinal axis of the first periscope; section *c* between the mirror 4 of the first periscope and the mirror 6 of the second periscope which at the same time is the exit axis of the first periscope and the entrance axis of the second periscope; section *d* between the mirrors 6 and 7 as longitudinal axis of the second periscope; and section *e* between the mirror 7 of the second periscope and the place of projection on the recording medium 2 which at the same time forms the exit axis of the second periscope.

The section *a* of the optical axis lies in the extension of the axis A—A. The section *b* is perpendicular to the section *a* and is swingable about it. The section c lies in the axis B—B around which the second support 8 is swingable. The section *d* is in its turn perpendicular to the section *c* and is swingable about it. The section *e* is perpendicular to the section *d* and to the surface of the recording medium 2. The length of all sections *a*, *b*, *c*, *d*, and *e* is constant regardless of the position of swing of the supports 5 and 8, and thus the entire length of the optical system also remains constant.

In operation, if the mirror 7 is displaced in the line direction 12 in order to compose the line, the section *d* of the optical axis is swung around the section c and the axis B—B respectively. At the same time the section b swings around the section a and the axis A—A respectively. The character projected on the recording medium always remains vertical regardless of the position of the mirrors 3, 4, 6, and 7 and it can therefore only be displaced parallel to itself.

The linear guide 11 can, in another particularly suitable embodiment, be so developed or supplemented that the mirror 7 can not only be displaced along the line of composition but also perpendicularly thereto from line to line, i.e., in two directions. In this case also, the overall length of the optical axis remains constant.

Having thus described the invention, it is to be understood that other seemingly different embodiments could be provided without departing from its spirit and scope. Accordingly, the foregoing specification and the drawing are to be interpreted as illustrative rather than in a limiting sense.

What is claimed is:

1. Apparatus for displacing the place of imaging on a recording medium in a photocomposing machine with the use of a mirror system arranged in the optical axis of an imaging system between a character support and the recording medium, which system includes four mirrors inclined 45° to the optical axis and directed in pairs parallel to each other, the position of at least one mirror with respect to the recording medium as well as the positions of the mirrors with respect to each other being variable for displacement of the place of imaging in particular along a line in such manner that the length of the optical path between the recording medium and the mirror facing the character support remains constant, characterized in that each pair of parallel directed mirrors (3, 4 and 6, 7 respectively) are connected on a common support (5 and 8 respectively) to form individual periscopes, that the first periscope (3, 4, 5) facing the character support (1) is swingable around its entrance axis (*a*) so that, regardless of its position, it is always directed, to the same position on the character support (1), that the second periscope (6, 7, 8) which faces the recording medium (2) is swingable about its optical entrance axis (*c*) which coincides with the exit axis of the first periscope in such a manner that the longitudinal axes (*b*, *d*) of the periscopes are swingable with respect to each other.

2. Apparatus according to claim 1, characterized by the fact that the mirror (7) of the second periscope (6, 7, 8), which mirror faces the recording medium (2), is guided for displacement parallel to the line direction (12).

3. Apparatus according to claim 2, characterized by the fact that an objective lens (13) is arranged on one of the supports (8).

* * * * *